US009528726B2

(12) United States Patent
Shapiro et al.

(10) Patent No.: US 9,528,726 B2
(45) Date of Patent: Dec. 27, 2016

(54) LOW CHARGE HYDROCARBON REFRIGERATION SYSTEM

(71) Applicant: Hussmann Corporation, Bridgeton, MO (US)

(72) Inventors: Doron Shapiro, St. Louis, MO (US); Norman E. Street, O'Fallon, MO (US); Chiao M. Lee, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 321 days.

(21) Appl. No.: 14/210,712

(22) Filed: Mar. 14, 2014

(65) Prior Publication Data

US 2015/0257548 A1 Sep. 17, 2015

(51) Int. Cl.

| | |
|---|---|
| ***F25B 7/00*** | (2006.01) |
| ***F25B 1/00*** | (2006.01) |
| ***F25B 25/00*** | (2006.01) |

(52) U.S. Cl.

CPC ..... *F25B 1/005* (2013.01); *F25B 7/00* (2013.01); *F25B 25/005* (2013.01); *F25B 2400/06* (2013.01); *F25B 2400/12* (2013.01); *F25B 2400/22* (2013.01)

(58) Field of Classification Search

CPC ..... F25B 25/005; F25B 7/00; F25B 2400/22; F25B 2400/12; F25B 2400/06; F25B 1/005

See application file for complete search history.

(56) References Cited

U.S. PATENT DOCUMENTS

| | | | | |
|---|---|---|---|---|
| 3,831,390 | A * | 8/1974 | Hopkins | F25B 15/06 62/101 |
| 5,440,894 | A | 8/1995 | Schaeffer et al. | |
| 6,085,531 | A * | 7/2000 | Numoto | F24F 11/0086 62/129 |
| 6,131,401 | A | 10/2000 | Ueno et al. | |
| RE37,119 | E | 4/2001 | Sherwood | |
| 6,311,512 | B1 | 11/2001 | Fung et al. | |
| 7,574,869 | B2 | 8/2009 | Shapiro | |
| 7,900,467 | B2 | 3/2011 | Allen | |
| 2005/0247070 | A1 | 11/2005 | Arshansky et al. | |
| 2007/0186569 | A1 | 8/2007 | Street et al. | |
| 2008/0289350 | A1 | 11/2008 | Shapiro | |
| 2009/0025404 | A1 | 1/2009 | Allen | |
| 2009/0120117 | A1 | 5/2009 | Martin et al. | |
| 2012/0180986 | A1 | 7/2012 | Mathews | |
| 2013/0167577 | A1 | 7/2013 | Street et al. | |
| 2013/0180268 | A1 | 7/2013 | Schlosser et al. | |
| 2013/0205821 | A1 | 8/2013 | Shapiro | |

OTHER PUBLICATIONS

International Search Report for Application No. PCT/US2015/013001 dated Apr. 29, 2015 (5 pages).
International Written Opinion for Application No. PCT/US2015/013001 dated Apr. 29, 2015 (9 pages).

* cited by examiner

*Primary Examiner* — Len Tran
*Assistant Examiner* — Ana Vazquez
(74) *Attorney, Agent, or Firm* — Michael Best & Friedrich LLP

(57) ABSTRACT

A refrigeration system including a plurality of circuits that have one or more heat exchangers providing heat exchange relationship relative to one or more of the other circuits. At least one of the circuits circulates a hydrocarbon refrigerant and includes a chiller unit or a merchandiser that has an evaporator.

12 Claims, 6 Drawing Sheets

LOW CHARGE HYDROCARBON REFRIGERATION SYSTEM

BACKGROUND

The present invention relates to refrigeration systems, and more particularly to a refrigeration system including a low charge hydrocarbon refrigerant circuit.

Refrigeration systems are used to condition merchandisers and other areas that require conditioned air (e.g., storage rooms, etc.) kept within a predetermined temperature range. Some existing systems use refrigerants such as R404a, R134a, or R744. In some instances, a hydrocarbon refrigerant (e.g., propane) is used.

For systems using a hydrocarbon refrigerant, the EPA requires that each refrigeration circuit have no more than 150 grams of hydrocarbon refrigerant to minimize the likelihood that leaked refrigerant will ignite and cause adverse conditions in the area surrounding the merchandiser. To meet this requirement, existing systems using hydrocarbon refrigerant have several (i.e. two or more) hydrocarbon refrigerant loops, each with no more than 150 grams refrigerant charge, that are arranged in parallel with each other to cooperatively condition the area needing to be cooled.

SUMMARY

The invention provides a modular, ultra-low charge refrigeration system that uses a hydrocarbon refrigerant (e.g., propane).

In one construction, the invention provides a refrigeration system including a first circuit with a first heat exchanger, a second heat exchanger, and a pump fluidly connected in series with the first heat exchanger and the second heat exchanger to circulate a coolant within the first circuit. The refrigeration system also includes a second circuit that circulates a hydrocarbon refrigerant in heat exchange relationship with the coolant in the first circuit within the second heat exchanger to cool the refrigerant. The second circuit includes a compressor, the second heat exchanger, and a refrigerated merchandiser, which defines a product support area. An evaporator is fluidly connected in series with the compressor and the second heat exchanger and positioned to condition the entire product support area within a predetermined temperature threshold at or below approximately 41 degrees Fahrenheit.

In another construction, the invention provides a refrigeration system including a first circuit that has a first heat exchanger, a second heat exchanger, and a pump fluidly connected to the first heat exchanger and the second heat exchanger to circulate a first coolant within the first circuit. The refrigeration system also includes a second circuit that circulates a fluid and a refrigerated merchandiser defining a product support area. An evaporator is in communication with the product support area to condition the area within a predetermined temperature range. The refrigeration system also includes a third circuit including the second heat exchanger, a chiller unit, and a compressor fluidly connected to the second heat exchanger and the chiller unit to circulate a hydrocarbon refrigerant in heat exchange relationship with the first coolant. Heat from the hydrocarbon refrigerant is absorbed by the first coolant within the second heat exchanger. The chiller unit is positioned in communication with the second circuit such that heat from the fluid is transferred to the hydrocarbon refrigerant in the chiller unit.

The third circuit defines a micro-chiller refrigerant loop having a refrigerant charge not exceeding approximately 150 grams of refrigerant.

In another construction, the invention provides a first circuit including a refrigerated merchandiser defining a product support area and having an evaporator to maintain the product support area within a predetermined temperature range. The first circuit further includes a chiller unit and a pump fluidly connected to the evaporator and the chiller unit to circulate a coolant within the first circuit. The refrigeration unit also includes a second circuit including a condenser, the chiller unit, and a compressor circulating a hydrocarbon refrigerant through the second circuit and in heat exchange relationship with the coolant within the chiller unit to extract heat from the coolant. Hydrocarbon refrigerant within the condenser is in heat exchange relationship with a fluid to discharge heat from the hydrocarbon refrigerant to the fluid, and the refrigerant charge of the second circuit does not exceed approximately 150 grams of hydrocarbon refrigerant.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
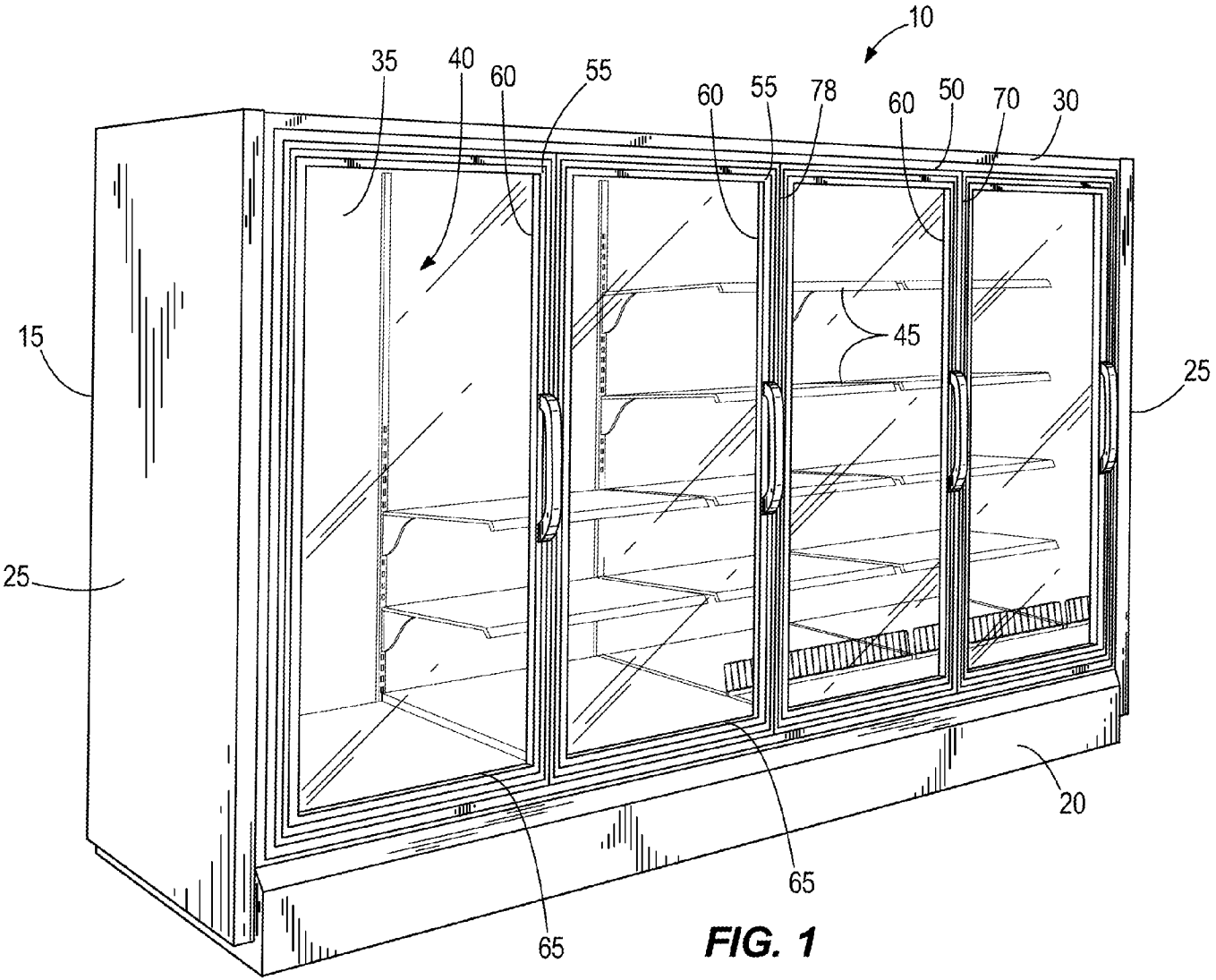
FIG. 1 is a perspective view of an exemplary refrigerated merchandiser embodying the invention.

FIG. 1 illustrates an exemplary refrigerated merchandiser 10 that may be located in a supermarket or a convenience store or other retail setting (not shown). The refrigerated merchandiser 10 includes a case 15 that has a base 20, side walls 25, a case top or canopy 30, and a rear wall 35. The area or volume partially enclosed by the base 20, the side walls 25, the canopy 30, and the rear wall 35 defines an interior space or product support area 40 that supports food product in the case 15 (e.g., on shelves 45). The product support area 40 is cooled by a refrigeration system 100, which will be described in greater detail below.

The case 15 also includes a casing or frame 50 located adjacent a front of the merchandiser 10 to support doors 55. In particular, the frame 50 includes vertical mullions 70 that define customer access openings 65 and that support the doors 55 over the openings 65. The openings 65 provide access to food product stored in the product support area 40. The mullions 70 are structural members spaced horizontally along the case 15.

Further with respect to FIG. 1, the base 20 is disposed substantially below the product support area 40 and can be supported by a floor or support surface (not shown) of the supermarket. The base 20 defines a lower portion of the product support area 40 that can support a portion of the food product in the case 15. The base 20 includes an air inlet located adjacent a lower portion of the customer access openings 65 and in fluid communication with the product support area 40. The canopy 30 is disposed substantially above the product support area 40 and defines an upper portion of the product support area 40 that has an air outlet.

Figure 2:
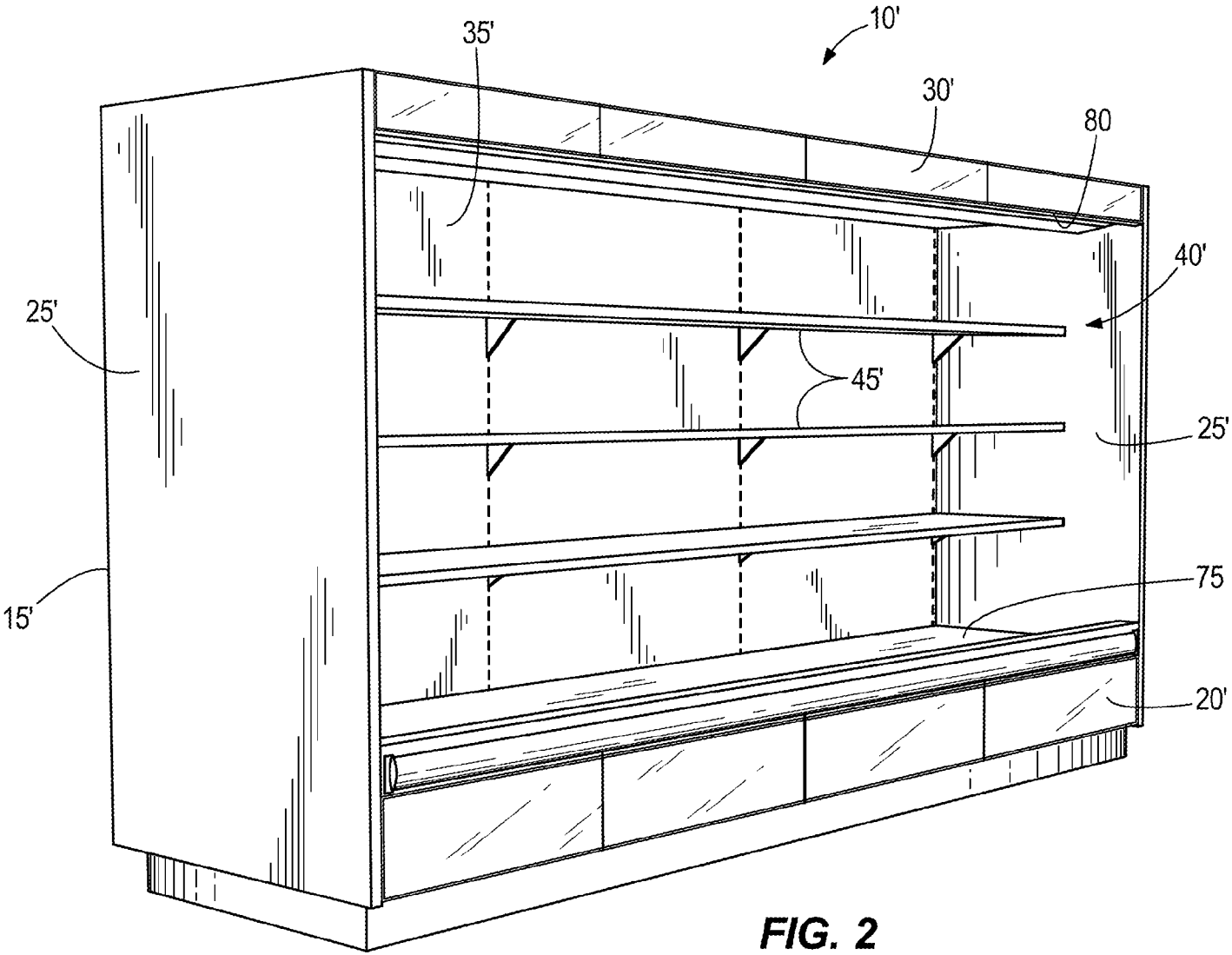
FIG. 2 is a perspective view of another exemplary refrigerated merchandiser embodying the invention

FIG. 2 illustrates another exemplary refrigerated merchandiser 10' that may be located in a supermarket or a convenience store or other retail setting (not shown). Similar to the merchandiser 10 discussed above with respect to FIG. 1, the merchandiser 10' includes a case 15' that has a base 20', side walls 25', a case top or canopy 30', and a rear wall 35'. The area partially enclosed by the base 20', the side walls 25', the canopy 30', and the rear wall 35' defines an interior space or product support area 40' that supports food product in the case 15' (e.g., on shelves 45'). The base 20' defines an interior bottom wall 75 and the canopy 30' defining a first interior top wall 80. The area bounded by the interior bottom wall 75, the first interior rear wall 35', and the first interior top wall 80 defines a product support area 40'. An open front face allows customers access to the food product stored in the case 15' without opening doors. The food product is stored on one or more shelves 45' in the product support area 40'. The illustrated construction shows an upright merchandiser 10', although the merchandiser 10' can be a horizontal merchandiser (e.g., "coffin"-style) or another style of merchandiser.

In general, the merchandisers 10, 10' can be a low temperature or a medium temperature merchandiser depending on the product supported in the product support areas 40, 40'. Low temperature merchandisers maintain the product support area 40, 40' at a temperature of less than approximately 32° F. Medium temperature merchandisers are configured to maintain the product support area 40, 40' within a temperature range of approximately 32° F. to approximately 41° F. Alternatively, the merchandisers 10, 10' may be configured to maintain the product support area 40, 40' at other temperatures (i.e., above 41° F.).

Figure 3:
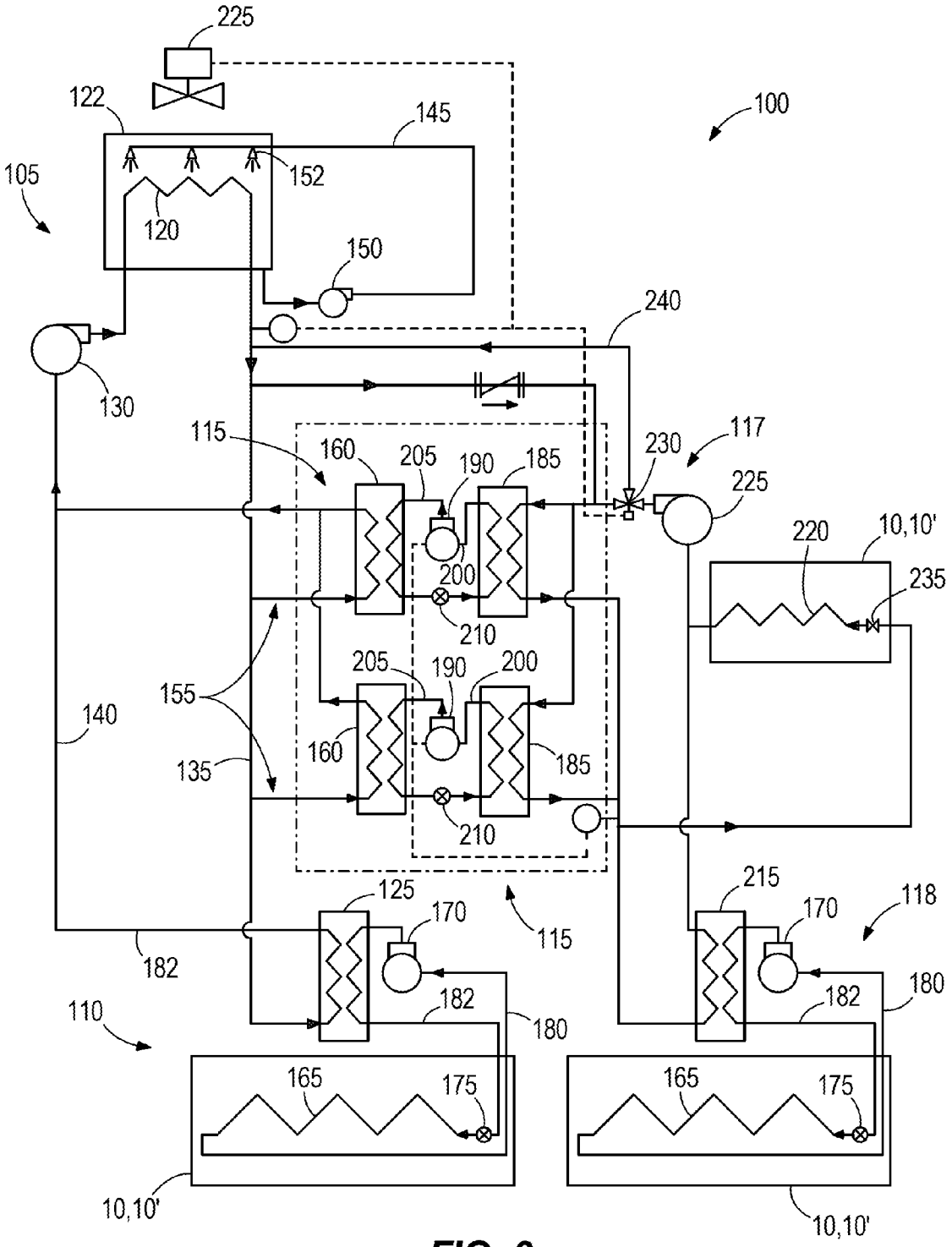
FIG. 3 is a schematic view of a refrigeration system including several refrigeration circuits for conditioning the product support areas of several merchandisers.

FIG. 3 illustrates an exemplary multi-circuit refrigeration system 100 that is used to condition the product support areas 40, 40'. Although not shown, the refrigeration system 100 can be used in any commercial setting (e.g., a retail store, supermarket, or an industrial setting) or other settings that have temperature-controlled environments (e.g., the merchandisers 10, 10' described with regard to FIGS. 1 and 2).

With reference to FIG. 3, the refrigeration system 100 includes a primary or first circuit 105 (referred to as the "first circuit 105" for purposes of description only) that circulates a first cooling fluid, one or more second circuits 110 (one shown) that circulate a second cooling fluid, one or more third or micro-chiller circuits 115 (two shown) that circulate a third cooling fluid, one or more fourth circuits 117 (one shown) that circulate a fourth cooling fluid, one or more fifth circuits 118 (one shown) that circulate a fifth cooling fluid. The first cooling fluid is described in detail as a first coolant including ambient water, although it should be understood that another cooling fluid can be used (e.g., glycol, or a water-glycol mixture). Also, while the second, third and fifth cooling fluids are described in detail as being the same cooling fluid, different fluids can be used among the circuits.

Figure 4:
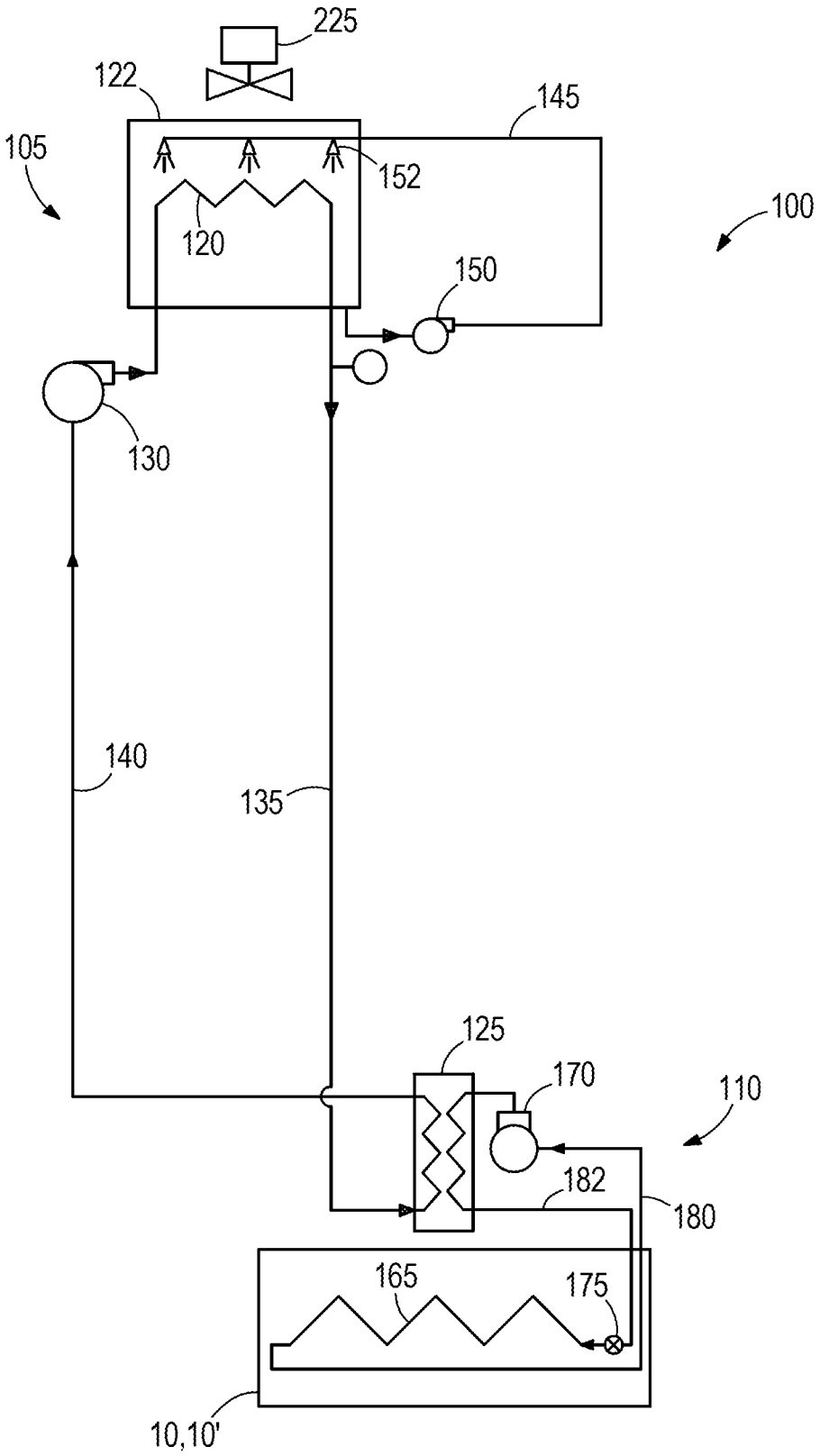
FIG. 4 is a schematic view of one refrigeration circuit of the refrigeration system of FIG. 2 including a high side cooling loop and a low side refrigerant loop.

FIGS. 3 and 4 show the first circuit 105 that includes a first heat exchanger 120 disposed in a housing 122, a second heat exchanger 125, and a pump 130 that circulates the first coolant serially through the components of the first circuit 105. The first circuit 105 is in heat exchange relationship with the second circuit 110 via the second heat exchanger 125.

As illustrated, the first heat exchanger 120 is an evaporative fluid cooler (e.g., located on a rooftop of the commercial setting to discharge heat from the coolant in the first circuit 105 to the surrounding environment), although other types of heat exchangers may be used. A fan 132 is positioned to direct outside air across the heat exchanger 120. The first heat exchanger 120 is in fluid communication with the second heat exchanger 125 via an inlet line 135 and an outlet line 140. The illustrated first heat exchanger 120 also includes a spray circuit 145 with a secondary pump 150 that circulates water accumulated in the bottom of the housing 122 through spray outlets 152 positioned at the top of the housing 122 above the heat exchanger 120.

Figure 5:
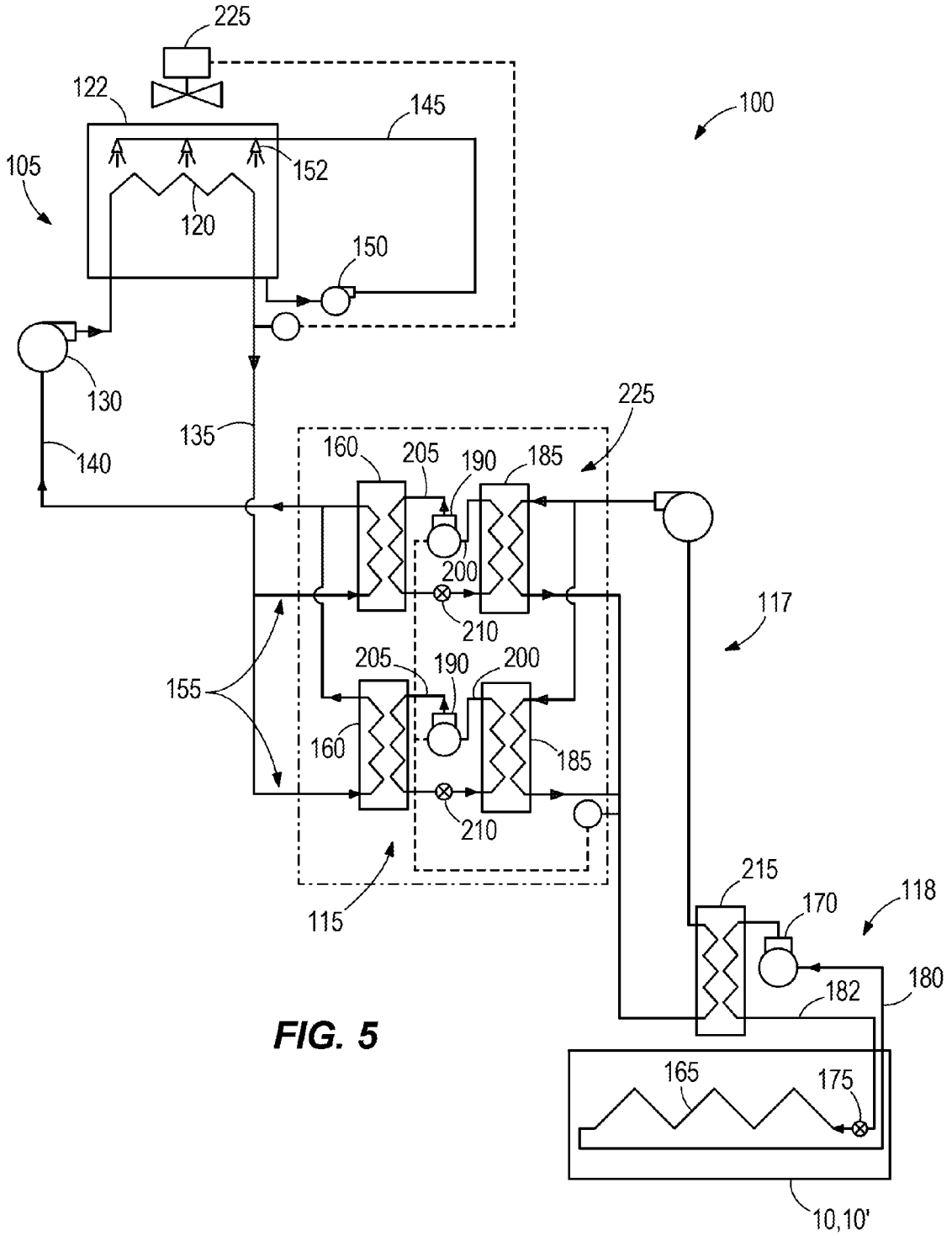
FIG. 5 is a schematic view of another refrigeration circuit of the refrigeration system of FIG. 2 including a high side cooling loop, a low side refrigerant loop, and an intermediate refrigerant loop in heat exchange relationship with the high side and low side loops.

Referring to FIGS. 3 and 5, the first circuit 105 also includes a sub-circuit 155 that is fluidly coupled between the inlet line 135 and the outlet line 140. The sub-circuit 155 is in heat exchange relationship with the micro-chiller circuits 115 via third heat exchangers 160. A valve (not shown) can be coupled to the inlet line 135 and/or the outlet line 140 to control flow of the first cooling fluid to and/or from the second heat exchanger 125, as well as relative to the sub-circuits 155. Additional components (expansion valve, receivers, accumulators, etc.) can also be provided in the first circuit 105.

Referring back to FIGS. 3 and 4, each second circuit 110 circulates the second cooling fluid or refrigerant (described as the "first refrigerant" for purposes of description) to condition the product support area 40, 40' of one or more merchandisers 10, 10'. The first refrigerant is a hydrocarbon refrigerant such as propane. Part or all of the second circuit 110 can be located remote from the first circuit 105.

With reference to FIGS. 1-4 and 5, each second circuit 110 includes the secondary heat exchanger 125, an evaporator 165, a compressor 170 (e.g., one compressor 170 or several compressors 170 in an assembly), and an expansion valve 175 disposed upstream of the evaporator 165. The evaporator 165 is in communication with the product support area 40, 40' to condition the area 40, 40' within a predetermined temperature threshold based on the type of product to be cooled. The evaporator 165 (e.g., microchannel or round tube plate-fin) is fluidly coupled with and returns heated first refrigerant to the compressor 170 via a suction line 180. The evaporator 165 also is fluidly coupled with the secondary heat exchanger 125 via an inlet line 182 to receive cooled, condensed hydrocarbon refrigerant from the secondary heat exchanger 125. The second circuit 110 also can include other components (valves, receivers, accumulators, etc.). The charge of hydrocarbon refrigerant in each second circuit 110 does not exceed, for example, approximately 150 grams of hydrocarbon refrigerant (e.g., the refrigerant charge is at or below 150 grams), although in some constructions, the refrigerant charge may exceed 150 grams (e.g., based on the maximum charge established by government or safety regulations).

Figure 6:
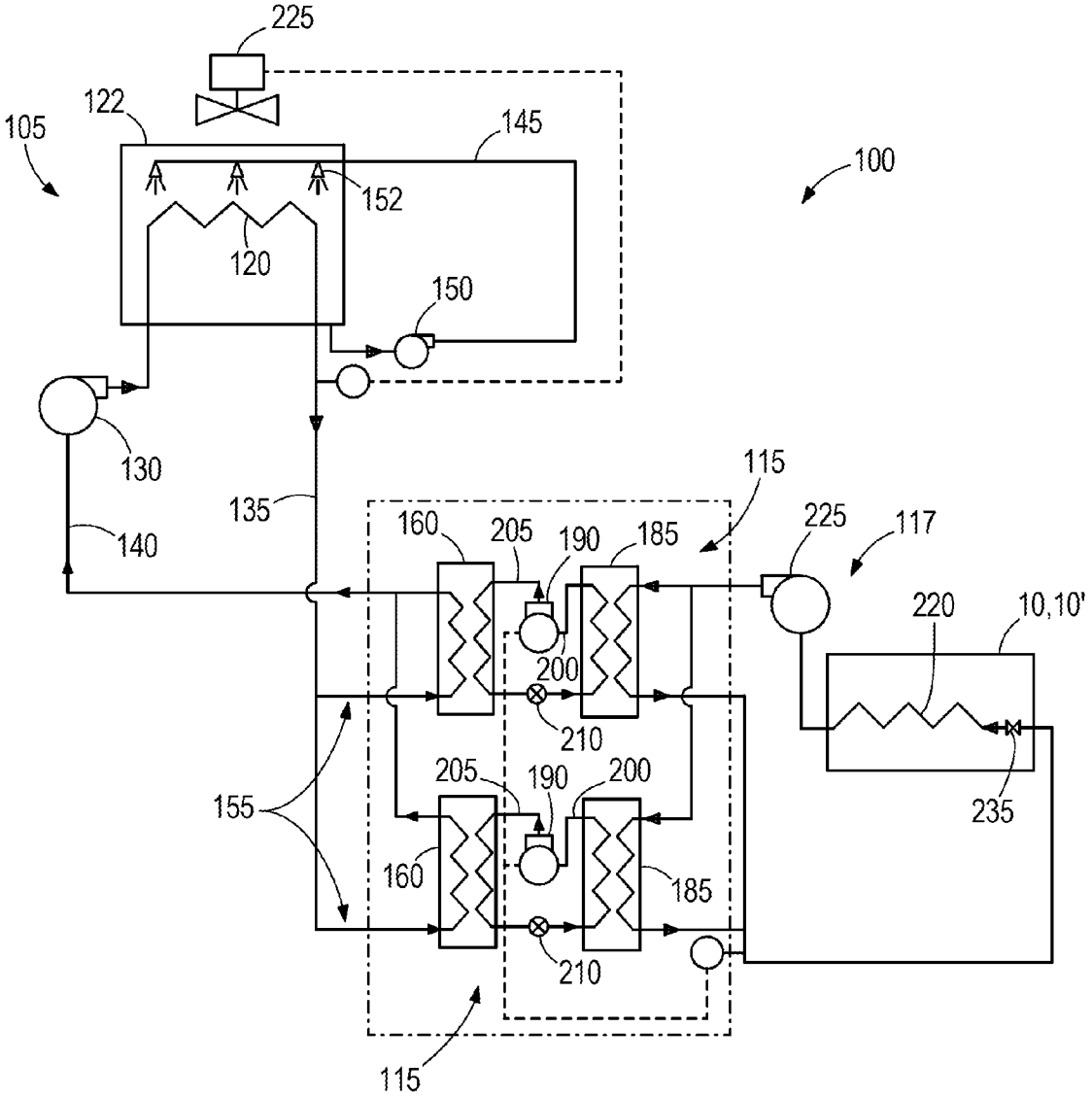
FIG. 6 is a schematic view of another refrigeration circuit of the refrigeration system of FIG. 2 including a high side cooling loop, a low side refrigerant loop, and an intermediate refrigerant loop in heat exchange relationship with the high side and low side loops.

FIGS. 3, 5, and 6 illustrate the micro-chiller circuits 115 that circulate a hydrocarbon refrigerant (e.g., propane) as the third cooling fluid (referred to as the "second refrigerant" for purposes of description). Each micro-chiller circuit 115 includes the third heat exchanger 160, a chiller unit 185, and a compressor 190 (e.g., one compressor 190 or several compressors 190) fluidly connected to the heat exchanger 160 and the chiller unit 185 to circulate the second refrigerant through the circuit 115. The micro-chiller circuit 115 also can include other components (valves, receivers, accumulators, etc.). As shown, the compressors 190 cycle on/off based on the temperature of the fourth cooling fluid exiting the chiller units 185 within the fourth circuit 117.

The chiller unit 185 is fluidly coupled with the compressor 190 via a suction line 200 to deliver heated hydrocarbon refrigerant from the chiller unit 185 to the compressor 190. The chiller unit 185 also is fluidly coupled with the third heat exchanger 160 via an inlet line 205 to receive cooled, condensed hydrocarbon refrigerant. As shown, an expansion valve 210 can be located in the inlet line 205 to create a pressure differential to control the pressure of the fluid delivered to the chiller unit 185. The refrigerant charge of the micro-chiller circuit 115 does not exceed, for example, approximately 150 grams of hydrocarbon refrigerant.

Referring back to FIGS. 3, 5, and 6, the fourth circuit 117 circulates a non-hydrocarbon fluid as the fourth cooling fluid to condition the product support area 40, 40' of one or more merchandisers 10, 10' within the circuit 117. In the illustrated circuit 117, the fourth cooling fluid is a water or water-glycol mixture (referred to as the "second coolant" for purposes of description). The fourth circuit 117 includes the chiller units 185, a fourth heat exchanger 215, an evaporator 220, a pump 225, a multi-port valve 230, and a valve 235 positioned upstream of the evaporator 220. The evaporator 220 is disposed in the merchandiser 10, 10' to condition the product display area 40, 40'. As shown, the fourth heat exchanger 215 and the evaporator 220 are fluidly coupled in parallel to the pump 225 such that the fourth cooling fluid is divided between the heat exchanger 215 and the evaporator 220 (e.g., by a valve, not shown). The fourth circuit 117 also can include other components (valves, receivers, accumulators, etc.). As illustrated, the fourth circuit 117 conditions product at temperatures above approximately 40° F. (i.e. product that can be cooled directly with chilled coolant).

The fifth circuit 118 circulates a hydrocarbon refrigerant as the fifth cooling fluid (referred to as the "third refrigerant" for purposes of description) and is in heat exchange relationship with the fourth circuit 117 via the fourth heat exchanger 215. With the exception of the heat exchanger 215 in place of the heat exchanger 125, the components of the fifth circuit are the same as the second circuit 110. In particular, the fifth circuit 118 includes the fourth heat exchanger 215, the evaporator 165, the compressor 170 (e.g., one compressor 170 or several compressors 170), and the expansion valve 175 disposed upstream of the evaporator 165. The evaporator 165 is in communication with the product support area 40, 40' to condition the area 40, 40' within a predetermined temperature threshold based on the type of product to be cooled. The evaporator 165 (e.g., microchannel or round tube plate-fin) is fluidly coupled with and returns heated hydrocarbon refrigerant to the compressor 170 via a suction line 180. The evaporator 165 also is fluidly coupled with the fourth heat exchanger 215 via an inlet line 182 to receive cooled, condensed hydrocarbon refrigerant from the fourth heat exchanger 215. The fifth circuit 118 also can include other components (valves, receivers, accumulators, etc.). The charge of hydrocarbon refrigerant in each second circuit 110 does not exceed approximately 150 grams of hydrocarbon refrigerant (e.g., the refrigerant charge is at or below 150 grams).

FIG. 3 illustrates that the refrigeration system 100 can be implemented with all of the circuits 105, 110, 115, 117, 118, and FIGS. 4-6 illustrate that the refrigeration system 100 can be implemented with different combinations of the circuits 105, 110, 115, 117, 118. With reference to FIG. 3, the refrigeration system is illustrated as being implemented with all of the circuits 105, 110, 115, 117, 118. In operation, beginning with the fourth circuit 117, the second coolant is circulated by the pump 225 to the multi-port valve 230, which directs the second coolant directly to the chiller units 185 when the temperature of the first coolant is below approximately 38° F. When the temperature of the first coolant is above this threshold temperature, the multi-port valve 230 directs the second coolant through an auxiliary loop 240 that is connected to the valve 230 and to the fourth circuit at a point upstream of the chiller units 185. Second coolant that is circulated through the auxiliary loop 240 is at least partially cooled by heat exchange with the first coolant circulating through the first circuit 105 downstream of the first heat exchanger 120. The cooled second coolant is then directed through the chiller units 185 and, depending on the temperature of the second coolant exiting the chiller units 185, is further cooled by heat exchange with the second refrigerant circulating through the micro-chiller circuits 115.

With continued reference to FIG. 3, second coolant exiting the chiller units 185 is delivered to the fourth heat exchanger 215 and to the evaporator 220 in parallel (e.g., via a valve, not shown). Second coolant flowing through the evaporator 220 is in heat exchange relationship with air flowing through the evaporator 220 so that the product support area 40, 40' can be conditioned based on predefined parameters. Heated second coolant exiting the evaporator 220 is returned to the pump 225.

The fourth heat exchanger 215 functions as a condenser for the fifth circuit 118 to reject heat from the hydrocarbon refrigerant in the circuit 110 to the second coolant in the fourth circuit 117. The condensed hydrocarbon refrigerant in the fifth circuit 118 is directed from the heat exchanger 215 through the inlet line 182 to the evaporator 165 through the expansion valve 175. The evaporator 165 is in a heat exchange relationship with air passing through the evaporator 165 to condition the product support area 40' 40'. Heated hydrocarbon refrigerant is then directed to the compressor 170 through the suction line 180 and compressed before returning to the heat exchanger 125.

After heat is transferred from the hydrocarbon refrigerant to the second coolant within the heat exchanger 215, the second coolant returns to the pump 225. As illustrated, second coolant exiting the heat exchanger 215 combines with second coolant exiting the evaporator 220 upstream of the pump 225.

FIG. 3 further illustrates that the second coolant in the fourth circuit 117 is in heat exchange relationship with the second refrigerant in each micro-chiller circuit 115 to reject heat from the second coolant to the second refrigerant. Heated second refrigerant in each of the circuits 115 is drawn into the compressor 190 via the suction line 200 and then compressed before circulating through the third heat exchanger 160 where heat is rejected from the refrigerant to the first coolant in the first circuit 105.

In operation, the third heat exchanger 160 functions as a condenser for the micro-chiller circuit 115 to reject heat from the hydrocarbon refrigerant in the circuit 115 to the cooling fluid in the first circuit 105. After heat is transferred from the hydrocarbon refrigerant to the first coolant within the heat exchanger 160, the heated first coolant is directed through the sub-circuit 155 to the outlet line 140 upstream of the pump 130.

The second heat exchanger 125 functions as a condenser for the second circuit 110 to reject heat from the hydrocarbon refrigerant in the circuit 110 to the first coolant circulating within the first circuit 105. Condensed hydrocarbon refrigerant in the second circuit 110 is then directed through the inlet line 182 to the evaporator 165 through the expansion valve 175. The evaporator 165 is in a heat exchange relationship with air that is directed to the product support area 40, 40' to condition the area 40' 40'. The heated refrigerant is then directed to the compressor 170 through the suction line 180 and compressed before returning to the heat exchanger 125.

After heat is transferred from the hydrocarbon refrigerant to the first coolant within the heat exchanger 125, the heated first coolant is directed to the first heat exchanger 120 by the pump 130. As illustrated, heated first coolant returning from the second heat exchanger 125 is combined with heated first coolant returning from the heat exchangers 160 of the sub-circuits 155 upstream of the pump 130. The combined, heated first coolant is then pumped to the first heat exchanger 120. Heat from the first coolant flowing through the heat exchanger 120 is transferred to fluid sprayed onto the heat exchanger 120 by the spray outlets 152 via evaporative cooling. The fan 132 increases the evaporative cooling effect. The cooled first coolant is returned to the heat exchanger 125 and to the sub-circuits 155 (e.g., via a valve, not shown), and fluid accumulated at the bottom of the housing 122 returns to the spray outlets 152 via the pump 150.

FIG. 4 illustrates an exemplary implementation of the refrigeration system 100 that includes a portion of the first circuit 105, without the sub-circuit 155, in heat exchange relationship with the second circuit 110. The first and second circuits 105, 110 operate as described with regard to FIG. 3 to condition the product support area 40, 40'. As illustrated, the closed loop circuit 110 minimizes the amount of refrigerant charge needed to condition the area 40, 40' while still maximizing the efficiencies of hydrocarbon refrigerant. Furthermore, by providing discrete circuits 105, 110, the circuits 105, 110 can be implemented with or without additional circuits.

FIG. 5 illustrates another exemplary implementation of the refrigeration system 100 that includes a portion of the first circuit 105, the micro-chiller circuits 115, a portion of the fourth circuit 117, and the fifth circuit 118. As shown, the first circuit 105 is provided with the sub-circuits 155 and without connection to the second heat exchanger 125, and the fourth circuit 117 is provided with a closed loop between the micro-chiller circuits 115 and the fifth circuit 118 without connection to the evaporator 220. As described with regard to FIG. 3, the third hydrocarbon refrigerant within the fifth circuit 118 is in heat exchange relationship with the second coolant in the fourth circuit 117 to reject heat to the second coolant. In turn, the second coolant is in heat exchange relationship with the second refrigerant within the chiller units 185 to reject heat to the second refrigerant. Heat from the second refrigerant in the circuit 115 is then rejected to the first coolant within the third heat exchangers 160, and heat from the first coolant is rejected to the surrounding environment within the first heat exchanger 120.

FIG. 6 illustrates another exemplary implementation of the refrigeration system 100 that includes a portion of the first circuit 105, the micro-chiller circuits 115, and a portion of the fourth circuit 117. As shown, the first circuit 105 is provided with the sub-circuits 155 and without connection to the second heat exchanger 125, and the fourth circuit 117 is provided with a closed loop between the micro-chiller circuits 115 and the evaporator 220 without connection to the fifth circuit 118. As described with regard to FIG. 3, the second coolant is in heat exchange relationship with air that conditions the area 40, 40', and heated second coolant in the fourth circuit 117 is rejected to the second refrigerant within the chiller units 185. Heat from the second refrigerant is then rejected to the first coolant within the heat exchangers 160, and heat from the first coolant is rejected to the surrounding environment within the heat exchanger 120.

By providing discrete, closed loop merchandiser hydrocarbon refrigerant circuits (e.g., circuits 110, 118) and micro-chiller circuits 115 that circulate hydrocarbon refrigerant, the amount of refrigerant charge in each circuit can be kept small while still maximizing the efficiencies of hydrocarbon refrigerant. Further, hydrocarbon refrigerant such as propane is implemented in different parts of the refrigeration system 100, not just in an intermediate circuit (e.g., in the micro-chiller circuits 115) or in a low side circuit (like the second or fifth circuits 110, 118). In other words, propane or another hydrocarbon refrigerant can be implemented in several discrete refrigerant loops to increase the efficiency of the overall system 100 and mitigating the potential for flammability risk.

Various features and advantages of the invention are set forth in the following claims.

The invention claimed is:

1. A refrigeration system comprising:

a first circuit including a first heat exchanger, a second heat exchanger, and a pump fluidly connected to the first heat exchanger and the second heat exchanger to circulate a first coolant within the first circuit;

a second circuit circulating a fluid, the second circuit including a refrigerated merchandiser defining a product support area and having an evaporator in communication with the product support area to condition the area within a predetermined temperature range; and a third circuit including the second heat exchanger, a chiller unit, and a compressor fluidly connected to the second heat exchanger and the chiller unit to circulate a hydrocarbon refrigerant in heat exchange relationship with the first coolant such that heat from the hydrocarbon refrigerant is absorbed by the first coolant within the second heat exchanger, the chiller unit positioned in communication with the second circuit such that heat from the fluid is transferred to the hydrocarbon refrigerant in the chiller unit; and a fourth circuit in heat exchange relationship with each of the second circuit and the third circuit, wherein the second circuit includes a condenser and the fourth circuit includes the chiller unit and a pump circulating a second fluid through the condenser in direct heat exchange relationship with the fluid of the second circuit to extract heat from the fluid, and wherein the second fluid is further in direct heat exchange relationship with the hydrocarbon refrigerant within the chiller unit to discharge heat to the third circuit, wherein the third circuit has a refrigerant charge not exceeding approximately 150 grams of refrigerant.

2. The refrigeration system of claim 1, wherein the first coolant includes a water and glycol mixture, and wherein the first heat exchanger includes an evaporative cooler having a spray circuit.

3. The refrigeration system of claim 1, wherein the merchandiser includes one of a medium temperature display case and a low temperature display case.

4. The refrigeration system of claim 1, wherein the fluid of the second circuit includes hydrocarbon refrigerant, and wherein a second refrigerant charge of the second circuit does not exceed approximately 150 grams of hydrocarbon refrigerant.

5. The refrigeration system of claim 4, wherein the evaporator is positioned to condition the entire product support area of the refrigerated merchandiser within a predetermined temperature threshold at or below approximately 41 degrees Fahrenheit.

6. The refrigeration system of claim 1, wherein the refrigerated merchandiser of the second circuit is a first merchandiser, and wherein the fourth circuit further includes a second refrigerated merchandiser defining a second product support area and having a second evaporator in fluid communication with the pump and the chiller unit.

7. The refrigeration system of claim 6, wherein an evaporation temperature associated with the evaporator of the first refrigerated merchandiser is below approximately 41 degrees Fahrenheit, and wherein an evaporation temperature associated with the second evaporator of the second refrigerated merchandiser is above approximately 40 degrees Fahrenheit.

8. The refrigeration system of claim 1, wherein the second fluid includes at least one of water and glycol.

9. The refrigeration system of claim 1, further comprising a fifth circuit including a second condenser, a second evaporator, and a second compressor arranged in series relationship with each other, wherein the second condenser defines a cascade heat exchanger between the first circuit and the fifth circuit, wherein the second compressor circulates a second hydrocarbon refrigerant in direct heat exchange relationship with the first coolant within the second condenser, and wherein a second refrigerant charge of the fifth circuit does not exceed approximately 150 grams of hydrocarbon refrigerant.

10. A refrigeration system comprising:

a first circuit including a first refrigerated merchandiser defining a product support area and having an evaporator to maintain the product support area within a predetermined temperature range, the first circuit further including a chiller unit and a pump fluidly connected to the evaporator and the chiller unit to circulate a coolant within the first circuit;

a second circuit including a condenser, the chiller unit, and a compressor circulating a hydrocarbon refrigerant through the second circuit and in heat exchange relationship with the coolant within the chiller unit to extract heat from the coolant; and a third circuit circulating a hydrocarbon refrigerant, the third circuit including a second refrigerated merchandiser defining a second product support area and having a second evaporator in communication with the second product support area to condition the area within a second predetermined temperature range, wherein the hydrocarbon refrigerant within the condenser is in heat exchange relationship with a fluid to discharge heat from the hydrocarbon refrigerant to the fluid, wherein the first circuit is in heat exchange relationship with the third circuit to extract heat from the hydrocarbon refrigerant of the third circuit, wherein the hydrocarbon refrigerant of the second circuit is in heat exchange relationship with the coolant of the first circuit to extract heat from the hydrocarbon refrigerant of the third circuit, and wherein a refrigerant charge of the second circuit does not exceed approximately 150 grams of hydrocarbon refrigerant.

11. The refrigeration system of claim 10, further comprising a fourth circuit including the condenser, wherein the fluid includes one of a refrigerant and a coolant circulated through the fourth circuit.

12. The refrigeration system of claim 10, wherein the fluid comprises ambient air and the condenser is an air-cooled condenser.

* * * * *